United States Patent [19]

Norris

[11] Patent Number: 4,514,070

[45] Date of Patent: Apr. 30, 1985

[54] FILM ASSEMBLAGE INCLUDING A CANNISTER FOR HOUSING A FILM CASSETTE DURING PROCESSING OF FILM

[75] Inventor: Philip R. Norris, No. Reading, Mass.

[73] Assignee: Polaroid Corporation, Cambridge, Mass.

[21] Appl. No.: 606,204

[22] Filed: May 2, 1984

[51] Int. Cl.[3] ..... G03D 13/04

[52] U.S. Cl. ..... 354/313; 354/275; 354/336

[58] Field of Search ..... 354/310, 311, 312, 313, 354/314, 316, 323, 331, 336, 337, 275, 83, 89, 90, 92, 91; 352/78 R, 130

[56] References Cited

U.S. PATENT DOCUMENTS

| | | | |
|---|---|---|---|
| 1,501,904 | 7/1924 | Harris | 354/331 |
| 3,260,186 | 7/1966 | Lowell | 354/313 |
| 3,383,998 | 5/1968 | Takats | 352/130 |
| 3,595,158 | 7/1971 | Long | 354/331 |
| 3,667,361 | 6/1972 | Meggs | 354/318 |
| 4,145,133 | 3/1979 | Wareham | 354/275 |
| 4,212,521 | 7/1980 | Stella | 352/130 |
| 4,265,525 | 5/1981 | Stella et al. | 354/76 |
| 4,283,134 | 8/1981 | Columbus | 354/275 |
| 4,291,966 | 9/1981 | Bendoni et al. | 354/275 |
| 4,291,968 | 9/1981 | Work | 354/313 |
| 4,374,195 | 2/1983 | Hutchinson | 430/499 |
| 4,429,981 | 2/1984 | Frazier | 354/316 |

OTHER PUBLICATIONS

"The Man Who Fell to Earth" by Walter Tevis, published by Fawcett Publications Inc. in 1963, pp. 27 through 29.

Research Disclosure, Apr. 1980, pp. 132–134, Disclosure No. 19219.

*Primary Examiner*—A. A. Mathews

*Attorney, Agent, or Firm*—Alfred E. Corrigan

[57] ABSTRACT

A photographic film assemblage including a cannister for housing a film cassette, a film cassette having a film spool rotatably supported therein, and a length of self-developing type film coiled about the spool with one of its ends secured to the spool and its other end extending to the exterior of the film cassette for subsequent attachment to a film take-up member of a camera. Also located within the cannister is a chamber containing a supply of processing fluid. After the film has been exposed and rewound into the cassette, the film cassette is reinserted into the cannister. The supply of processing fluid is then permitted to flow from the chamber and into contact with the film in the film cassette where it initiates formation of visible images within the film.

10 Claims, 4 Drawing Figures

FILM ASSEMBLAGE INCLUDING A CANNISTER FOR HOUSING A FILM CASSETTE DURING PROCESSING OF FILM

RELATED APPLICATION

This application is related to the copending application Ser. No. 606,203, filed on instant date herewith, by Richard C. Kee and Philip R. Norris and entitled "Film Cassette Usable As Processing Chamber".

BACKGROUND OF THE INVENTION

1. Field of the Invention

This invention relates to a photographic film assemblage containing film of the self-developing or instant type.

2. Description of the Prior Art

This invention relates to a photographic film assemblage including a cannister for initially housing a film cassette containing a roll of film, preferably of the 35 mm instant or self-developing transparency type, and more particularly, to such a film assemblage which is constructed in a manner that facilitates the processing of the film. It is known that a film assemblage including a film cassette containing a length of film may be placed in a camera, the film withdrawn from the film cassette and photographically exposed, and the exposed film rewound and processed in a film processor specially adapted for use with the film assemblage. Examples of such systems can be found in U.S. Pat. Nos. 4,291,966, 4,212,521, 4,145,133 and 3,260,186. While these systems have their own special advantages, the separate processor adds to the cost of the system, requires the proper positioning of the film cassette within the processor, and/or the threading of the film leader to a film take-up spool.

The requirement of a separate film processor has been obviated by using the film cassette as the chamber in which the film is processed. Examples of such systems are shown in U.S. Pat. Nos. 4,374,195, 4,283,134, 4,265,525, 3,667,361 and in disclosure No. 19219 on pages 132–134 of the April 1980 edition of Research Disclosure. However, each of these systems has at least one feature which detracts from its use in the processing of a single roll of film. For example, the systems disclosed in the '134 and '525 patents are not readily adapted for use with the processing of a roll of film, vis-a-vis the processing of individual planar type film units. While the system disclosed in the '361 patent relates to the processing of roll film, the cassette's volume is relatively large because of the separate chamber containing the processing fluid, thus detracting from its use in compact cameras. Further, the systems disclosed in the '195 patent and in the Research Disclosure article teach the placement of processing fluid container(s) in a chamber defined by what appears to be a conventional film spool and the interior surfaces of a film cassette. Such placement requires an unnecessarily large volume chamber for a given length of film or conversely the length of film stored in the chamber must be decreased in order to accommodate the volume of the processing fluid container(s). Still further, most of these systems teach the rupturing of the processing fluid container(s) while it is located exteriorly of the film cassette and while the film cassette is in a camera, thus possibly subjecting camera parts to the corrosive effects of any processing fluid which may be expressed from between layers of the film.

The prior art also teaches that the cannister or can which initially functions to house a film cassette containing a roll of fresh, unexposed film may also be used to hold the film cassette during processing of the film. More specifically, pages 27–29 of the paperback book entitled "The Man Who Fell To Earth" by Walter Tevis, published in 1963 by Fawcett Publications Inc. discloses a film assemblage having a cannister or can in which is located a supply of processing material, and a film cassette containing a roll of 35 mm self-developing color film. After the film has been photographically exposed, it is returned to the can and the can's cover replaced. A button in the cover is then depressed to process the film. However, this teaching is completely silent as to the location of the processing material or how it is able to enter the film cassette and contact the exposed film so as to initiate the formation of visible images therein.

From the foregoing it can be seen that there is a need for a simple and inexpensive means for facilitating the processing of a roll of photographically exposed film.

SUMMARY OF THE INVENTION

The instant invention relates to a photographic film assemblage including a cannister for initially housing a film cassette, a film cassette containing therein a roll of film, preferably transparency film of the instant or self-developing type, and more particularly, to such a film assemblage wherein the cannister is also adapted to function as a chamber in which the film cassette is to be located during processing of the film.

In a preferred embodiment of the invention, the film assemblage includes a cannister formed from any opaque material which will not adversely effect the quality of the film to be originally housed therein. The cannister includes a first chamber which is adapted to house the film cassette and a first cap for closing the open end of the first chamber in a manner which will protect the film from the adverse effects of the atmosphere, as is well known in the art. The cannister also includes a second end cap which is screwed onto a wall of the cannister so as to define a variable volume second chamber for containing a supply of processing fluid, preferably liquid. A passageway interconnects the first and second chambers so as to permit the flow of the processing fluid from the second chamber, such flow being initially prevented by a valve.

The film assemblage further includes a film cassette containing a film spool about which the film is wound. The film cassette comprises a shell having a generally cylindrical configuration with a lighttight film slot defined by opposite edges of the shell, and an end cap secured to each of the open ends of the shell. Each of the two end caps is formed with a spiral groove which is adapted to receive an edge of the film so as to space adjacent convolutions of the film from each other so as to maximize the contact between the processing fluid and the surface of the film. The film spool is formed with a passageway which is adapted to cooperate with the aforementioned passageway interconnecting the first and second chambers of the cannister so as to direct a flow of processing fluid from the second chamber to a chamber containing the wound film, such latter chamber being defined by the interior surfaces of the film cassette and an exterior surface of the film spool.

In use, the first end cap of the cannister is removed and the film cassette removed therefrom and placed in a camera where the film is progressively removed from the film cassette, photographically exposed and finally rewound into the film cassette. The film cassette is then returned to the first chamber of the cannister wherein the spool's passageway is located in communication with the passageway interconnecting the first and second chambers and the first end cap is reattached to the cannister. Processing of the film may be initiated in several ways. In a preferred form of the invention, the second end cap of the cannister is manually screwed in a direction which tends to reduce the volume of the second chamber. In the case where the processing fluid is a liquid, such turning of the second end cap results in the pressure of the liquid being rapidly increased to a level where it renders the valve inoperable, e.g., it ruptures the aforementioned valve. Thus ruptured, continued rotation of the second end cap results in the liquid being forced out of the second chamber, through the passageways, and into the chamber in the film cassette where it flows between and around the convolutions of film to initiate the formation of visible images therein. In the case where the processing fluid is in a gaseous form, it may be under pressure prior to screwing the second end cap in the direction mentioned. Thus, screwing the second end cap in said direction may result in the pressure being further elevated to a point where it disables the valve and moves under its own energy into the film cassette. In an alternative embodiment of the invention the cannister has a single end cap which is manually depressable so as to engage and move the film cassette and the first chamber in a direction which decreases the volume of the second chamber thus pressurizing its contents to a level at which the valve is rendered inoperable.

An object of the invention is to provide a photographic film assemblage having a cannister which not only functions to preserve the freshness of a roll of film prior to its use in a camera but also functions as a chamber in which a film cassette may be located during processing of the film subsequent to its exposure.

Another object of the invention is to provide a photographic film assemblage having a cannister which contains a chamber for storing a supply of processing fluid prior to its use in developing a length of exposed film.

Still another object of the invention is to provide a photographic film assemblage having a cannister which includes a variable volume chamber for containing a supply of fluid prior to its use in processing a roll of exposed film.

Other objects of the invention will in part be obvious and will in part appear hereinafter.

The invention accordingly comprises the photographic film assemblage possessing the construction, combination of elements and arrangement of parts which are exemplified in the following detailed disclosure, and the scope of the application of which will be indicated in the claims.

BRIEF DESCRIPTION OF THE DRAWINGS

For a fuller understanding of the nature and objects of the invention, reference should be had to the following detailed description taken in connection with the accompanying drawings wherein.

DETAILED DESCRIPTION OF THE INVENTION

Figure 1:
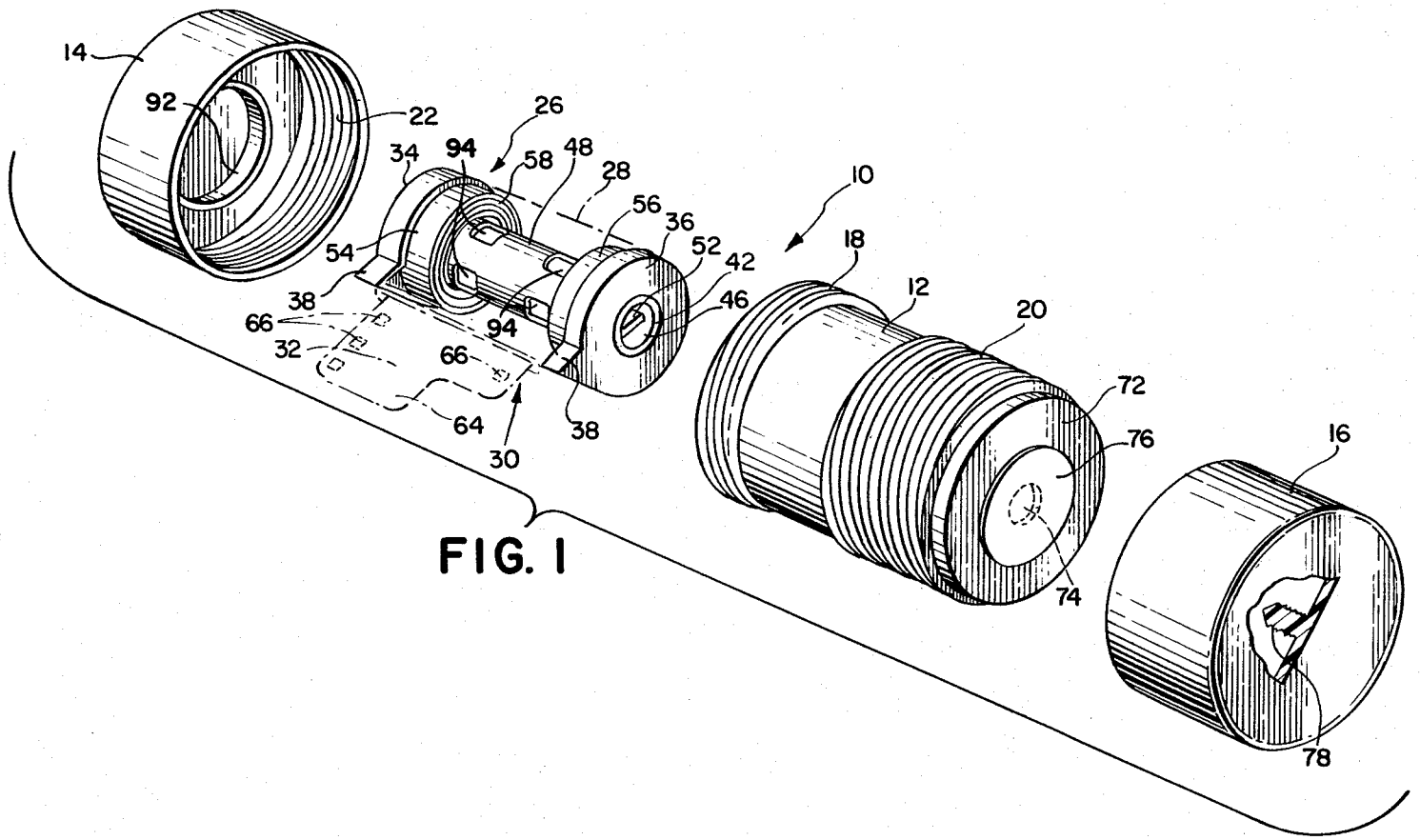
FIG. 1 is an exploded perspective view, partly in section and partly in broken lines, showing elements of a preferred embodiment of a photographic film assemblage.
Figure 2:
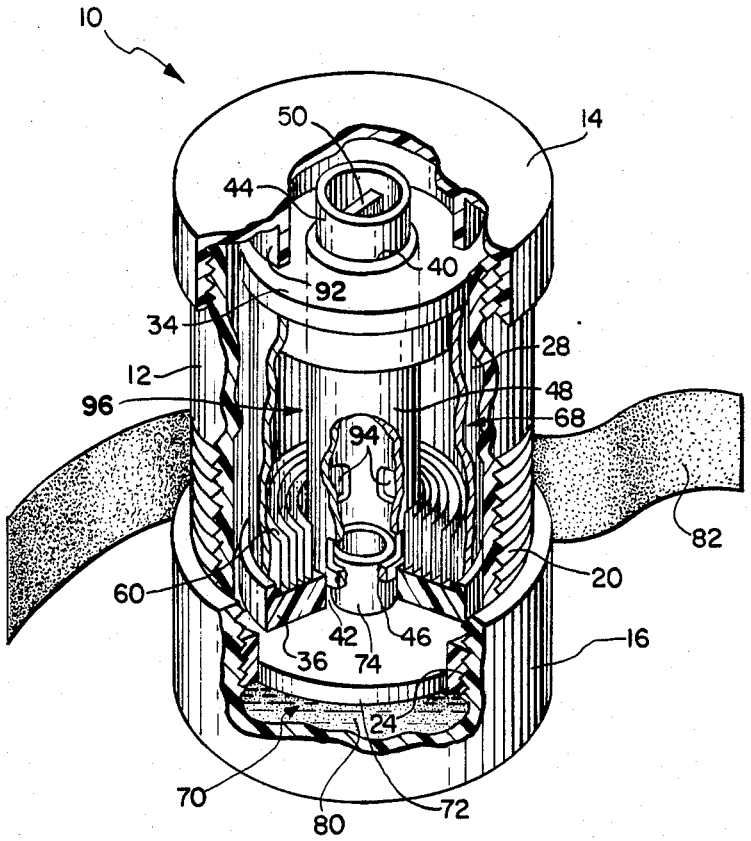
FIG. 2 is an enlarged perspective view, partly in section, of the photographic film assemblage shown in FIG. 1 without the film.
Figure 3:
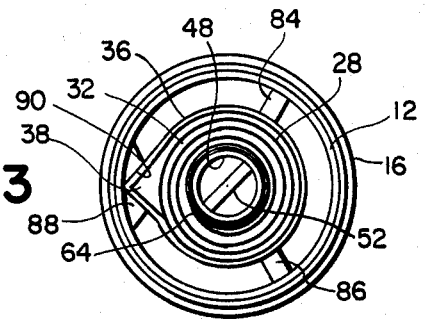
FIG. 3 is a top view of the photographic film assemblage with elements omitted for clarity.

Reference is now made to the drawings, and in particular to FIGS. 1 through 3 wherein is shown a preferred embodiment of a photographic film assemblage 10. The film assemblage 10 includes a generally cylindrically shaped can or cannister 12 having first and second end caps 14 and 16 which are adapted to be screwed onto the opposite ends of the cannister 12 via a set of threads 18 and 20 on the cannister which corresponds to a set of threads 22 and 24 on the first and second end caps 14 and 16. The film assemblage 10 also includes a generally cylindrically configured film cassette 26 comprising a shell 28 whose opposite edges are brought together to define an opening 30 through which a strip of film 32 may be advanced to the exterior of the film cassette 26. As is well known in the art, suitable means such as flocking may be located within the opening 30 to render it lighttight. The opposite ends of the film cassette are closed by a pair of end caps 34 and 36, each of which includes a wedge-shaped portion 38 located adjacent opposite sides of the lighttight opening 30.

The end caps 34 and 36 are provided with circular openings 40 and 42, respectively, which are adapted to rotatably support the journals 44 and 46 of a hollow film spool 48 having driving flanges 50 and 52 therein. Also, the end caps 34 and 36 are provided with helically wound members 54 and 56, respectively, each of which defines a helical groove 58 and 60, respectively, for receiving an opposite longitudinal edge of the film 32 so as to space adjacent convolutions of the film 32 from each other.

The film 32 is preferably of the 35 mm instant or self-developing transparency type and includes a narrowed first end 62 which is attached to the film spool 48 and a second opposite end 64 which is adapted to extend through the lighttight opening 30 in the film cassette 26 for subsequent attachment to a film take-up member of a camera. The opposite longitudinal edges of the film 32 may be provided with sprocket holes 66 for facilitating the unwinding and movement of the film from the film cassette.

The cannister 12 includes a first chamber 68 which is adapted to house the film cassette 26 prior to the film 32 being exposed in a camera, and a second chamber 70. As best seen in FIG. 2, the first chamber 68 is defined by the main cylindrical body of the cannister 12 and a transversely extending bottom wall 72, while the second chamber 70 is defined by the interior surfaces of the second end cap 16 and the wall 72. The first and second chambers 68 and 70, respectively, are interconnected by an open ended tube 74, see FIG. 2, which extends upwardly from the wall 72 into the first chamber 68. The lower end of the tube 74 is closed by a valve 76, shown schematically in FIG. 1, which may be rupturable or displacable under a force of a predetermined magnitude. For example, the second end cap 16 of the cannister 12 may be provided with a puncturing member 78 which is movable into engagement with the valve 76. A supply of processing fluid 80 is located within the second chamber 70, and means such as a length of adhesive tape 82 may be wrapped around the juncture of the second end cap 16 and the threads 20 for preventing any leakage of the processing fluid 80 therethrough.

After the film 32 has been photographically exposed in a camera and rewound into the film cassette 26, the latter is removed from the camera and placed within the first chamber 68 of the cannister 12. Proper positioning of the film cassette 26 is facilitated by inwardly extending longitudinally running members 84, 86 and 88, with the member 88 having a V-shaped groove 90 throughout its length for receiving the wedge shaped portions 38 of the film cassette's end caps 34 and 36, thus functioning to seal off the film withdrawal opening 30. Also, the driving flanges 50 and 52 are located at different distances from the exterior ends of their respective journals 44 and 46 such that the end cap 14 cannot be replaced when the tube 74 is located within the journal 44. Thus, when the film cassette 26 is properly located within the first chamber 68, as shown in FIGS. 2 and 3, the tube 74 is located within the journal 46. The first end cap 14 of the cannister 12 may then be screwed back onto the first chamber. During such action, an annular flange 92 on the cap 14 engages the end cap 34 of the film cassette 26 and urges it downwardly into firm engagement with the tube 74. Next, the tape 82 is removed and the end cap 16 of the cannister rotated in a direction, i.e., clockwise as viewed from below, which will reduce the volume of the second chamber 70 until the increasing pressure of the processing fluid 80 renders the valve 76 inoperable, such as by causing its rupture. Once ruptured, the processing fluid 80 is free to pass through the tube 74 and into the interior of the film spool 48 as rotation of the second end cap 16 is continued. The hollow interior of the film spool 48 functions in combination with a plurality of openings 94 to direct the processing fluid 80 to a chamber 96 defined in part by interior surfaces of the film cassette's shell 28 and the exterior surface of the film spool 48. Once inside the chamber 96, the processing fluid 80 flows between the convolutions of the film, around its edges, and through the sprocket holes 66 so as to fully contact the surfaces of the film thereby initiating the formation of visible images within the film 32. After a predetermined period of time, e.g., one or two minutes, the first end cap 14 may be removed, the film cassette 26 removed from the first chamber 68, and the fully processed film removed from the film cassette 26 for viewing and subsequent mounting.

Figure 4:
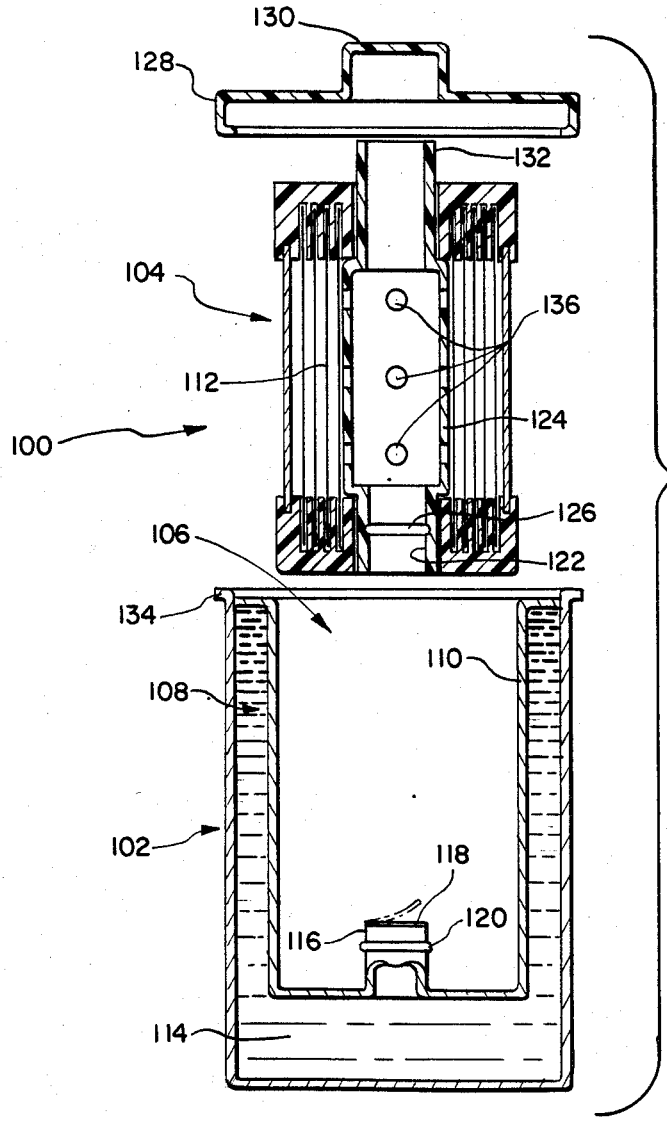
FIG. 4 is an exploded view, partly in section, of an alternative embodiment of the instant invention.

Reference is now made to FIG. 4 where an alternative embodiment of a photographic film assemblage 100 is shown. The film assemblage 100 includes a cylindrical cannister 102, and a correspondingly configured film cassette 104 which is similar to the previously described film cassette 26.

The cannister 102 is divided into first and second chambers 106 and 108, respectively, by a cylindrically configured insert 110. As in the preferred embodiment, the first chamber 106 is adapted to house the film cassette 104 prior to exposure of its film 112 and during the processing of the film 112, while the second chamber 108 contains a supply of processing fluid 114. The first and second chambers 106 and 108 are interconnected by an open ended tube 116 formed in the bottom wall of the insert 110. The top end of the tube 116 is temporarily closed by a rupturable or displaceable valve 118. Also, an O-ring 120 is located around the neck of the tube 116.

After the film 112 has been exposed and rewound into the film cassette 104, the latter is removed from the camera and placed within the first chamber 106 with a journal 122 of a film spool 124 telescopically receiving the tube 116. The interior surface of the journal 122 has an annular recess 126 therein for receiving the O-ring 120 thereby insuring a tight fit betwen the tube 116 and the hollow interior of the film spool 124. A resilient end cap 128 having a raised surface 130 for receiving the other journal 132 of the film spool 124 is then snapped into sealing engagement with a peripheral lip 134 of the cannister 102.

Processing of the film 112 is initiated by manually depressing the raised portion 130 of the end cap 128 thus moving it into engagement with the journal 132. Continued downward pressure on the journal 132 is transmitted by the film cassette 104 to the bottom wall of the insert 110 which in turn causes the internal pressure of the processing fluid 114 to rise as the insert 110 is forced in the downward direction, i.e., in a direction which will reduce the volume of the second chamber. This downward pressure is continued until the pressure of the processing fluid reaches a level whereat it renders the valve 118 inoperable to prevent the flow of processing fluid therethrough. As mentioned hereinbefore, the valve 118 may be ruptured by this pressure or merely displaced, as shown in broken lines in FIG. 4. Thus, with the valve 118 rendered inoperable, continued pressure on the end cap portion 130 forces the processing fluid 114 from the second chamber 108 as its volume decreases, and into the chamber containing the exposed film 112 via the hollow interior of the film spool and a plurality of apertures 136 contained therein. After one or two minutes, the film cassette 104 may be removed from the cannister 102 and the processed film removed from the film cassette 104 for viewing of the visible images.

Since certain changes may be made in the above-described invention without departing from the scope thereof, it is intended that all matter contained in the above description or shown in the accompanying drawings shall be interpreted as illustrative and not in a limiting sense.

What is claimed is:

1. A photographic film assemblage for use with commercially available, compact, still picture cameras of the type having means for operably locating a film cassette containing a single roll of film in a position in which the film is adapted to be progressively withdrawn from the film cassette and exposed prior to being rewound into the film cassette, said film assemblage comprising:

a cannister having means for defining a first chamber for housing a film cassette containing a roll of film, means for defining a second chamber for containing a supply of processing fluid, means connecting said first and second chambers, and means for temporarily blocking the movement of processing fluid from said second chamber via said connecting means;

a supply of processing fluid located within said second chamber;

a film cassette for housing a roll of self-developing type film, said film cassette including means defining a lighttight opening through which the film is adapted to be moved to the exterior of said film cassette for exposure thereof;

a length of self-developing type film coiled within said film cassette, said film including a first end attached to a support member located within said film cassette and a second opposite end which is adapted to extend through said lighttight opening for subsequent attachment to a film take-up member of a camera;

a support member rotatably supported within said film cassette said support member cooperating with an interior surface of said film cassette to define a third chamber for accommodating said film, said support member including means for directing a flow of said processing fluid from said connecting means to said third chamber when said film cassette is located within said first chamber of said cannister, and means for rendering said blocking means inoperable thereby permitting the flow of said processing fluid from said first chamber to said third chamber where it will initiate the formation of visible images in any photographically exposed film contained therein.

2. A photographic film assemblage as defined in claim 1 wherein said rendering means is adapted to decrease the volume of said second chamber while simultaneously increasing the pressure of said processing fluid to a level sufficient to render said blocking means inoperable to prevent the flow of said processing fluid through said connecting means.

3. A photographic film assemblage as defined in claim 2 wherein said means defining said second chamber includes an end cap and said rendering means includes means for allowing movement of said end cap in a direction which will reduce the volume of said second chamber.

4. A photographic film assemblage as defined in claim 3 wherein said means for allowing movement of said end cap comprises a threaded surface on said end cap and a correspondingly threaded surface on a wall of said first chamber.

5. A photographic film assemblage as defined in claim 3 wherein said rendering means further comprises means extending from said end cap and moveable into engagement with said blocking means as said end cap is moved in said direction.

6. A photographic film assemblage as defined in claim 1 wherein said means for defining said first chamber includes means for substantially covering said lighttight opening in said film cassette to thereby retard the flow of said processing fluid therefrom.

7. A photographic film assemblage as defined in claim 1 wherein said means for defining said first and second chambers includes a common wall.

8. A photographic film assemblage as defined in claim 7 wherein said first chamber is telescopically mounted within said second chamber for movement from a first position wherein the volume of said second chamber is at a maximum toward a second position wherein the volume of said second chamber is at a minimum.

9. A photographic film assemblage as defined in claim 8 wherein said rendering means comprises an end cap which is adapted to seal said first chamber after said film cassette has been positioned therein, said end cap including means manually moveable in a direction to move said film cassette and thus said first chamber toward said second position.

10. A photographic film assemblage as defined in claim 9 wherein said movement of said first chamber toward said second position results in said processing fluid being pressurized to a level sufficient to render said blocking means inoperable to prevent the flow of said processing fluid through said connecting means.

* * * * *